US010183300B2

(12) United States Patent
Nakano

(10) Patent No.: US 10,183,300 B2
(45) Date of Patent: Jan. 22, 2019

(54) SPRAY NOZZLE

(71) Applicant: H. IKEUCHI & CO., LTD., Osaka (JP)

(72) Inventor: Hisatsugu Nakano, Osaka (JP)

(73) Assignee: H. IKEUCHI & CO., LTD., Osaka (JP)

( * ) Notice: Subject to any disclaimer, the term of this patent is extended or adjusted under 35 U.S.C. 154(b) by 22 days.

(21) Appl. No.: 15/317,170

(22) PCT Filed: Jun. 5, 2015

(86) PCT No.: PCT/JP2015/066302
§ 371 (c)(1),
(2) Date: Dec. 8, 2016

(87) PCT Pub. No.: WO2015/198834
PCT Pub. Date: Dec. 30, 2015

(65) Prior Publication Data

US 2017/0106379 A1 Apr. 20, 2017

(30) Foreign Application Priority Data

Jun. 26, 2014 (JP) ..... 2014-131817

(51) Int. Cl.
*B05B 1/04* (2006.01)
*B22D 11/124* (2006.01)
(Continued)

(52) U.S. Cl.
CPC ..... *B05B 1/04* (2013.01); *B05B 1/042* (2013.01); *B05B 1/34* (2013.01); *B05B 7/0416* (2013.01);
(Continued)

(58) Field of Classification Search
CPC ..... B05B 1/04; B05B 7/04; B05B 7/0416; B05B 1/042; B05B 1/34; B05B 7/0483;
(Continued)

(56) References Cited

FOREIGN PATENT DOCUMENTS

JP 05329402 * 12/1993 ..... B05B 1/14
JP 2719073 11/1997
(Continued)

OTHER PUBLICATIONS

Search Report issued in Japan Patent Application No. PCT/JP2015/066302, dated Aug. 4, 2015.

*Primary Examiner* — Alexander Valvis
*Assistant Examiner* — Christopher R Dandridge
(74) *Attorney, Agent, or Firm* — Greenblum & Bernstein, P.L.C.

(57) ABSTRACT

Provided is a spray nozzle configured so that the angle of spray does not change even if the flow rate of liquid is adjusted largely. A circular conical primary hole narrowing toward the discharge-side front end is provided in a communicating manner at the discharge-side center of a primary flow passage extending along the center axis of a nozzle body, and a pair of secondary holes is provided on both sides of the primary hole in the width direction so as to communicate with the primary flow passage and the primary hole. The secondary holes are formed in an elongated shape, and portions of the long sides of the secondary holes on both sides, the portions facing each other across the primary hole, and both side portions of the primary hole are connected.

2 Claims, 7 Drawing Sheets

(51) Int. Cl.

| | |
|---|---|
| ***B22D 11/22*** | (2006.01) |
| ***B05B 7/04*** | (2006.01) |
| ***B05B 1/34*** | (2006.01) |
| *B21B 45/02* | (2006.01) |

(52) U.S. Cl.
CPC ..... *B05B 7/0483* (2013.01); *B22D 11/124* (2013.01); *B22D 11/1246* (2013.01); *B22D 11/22* (2013.01); *B21B 45/0233* (2013.01)

(58) Field of Classification Search
CPC .... B22D 11/124; B22D 11/1246; B22D 11/22
See application file for complete search history.

(56) References Cited

FOREIGN PATENT DOCUMENTS

| | | | | |
|---|---|---|---|---|
| JP | 2004-16846 | | 1/2004 | |
| JP | 2004298765 | * | 10/2004 | ..... B05B 7/04 |
| JP | 2007-237086 | | 9/2007 | |
| JP | 2008-168167 | | 7/2008 | |
| JP | 2008-296197 | * | 12/2008 | ..... B05B 1/04 |
| JP | 2010-221121 | | 10/2010 | |
| JP | 2011-67781 | | 4/2011 | |

* cited by examiner

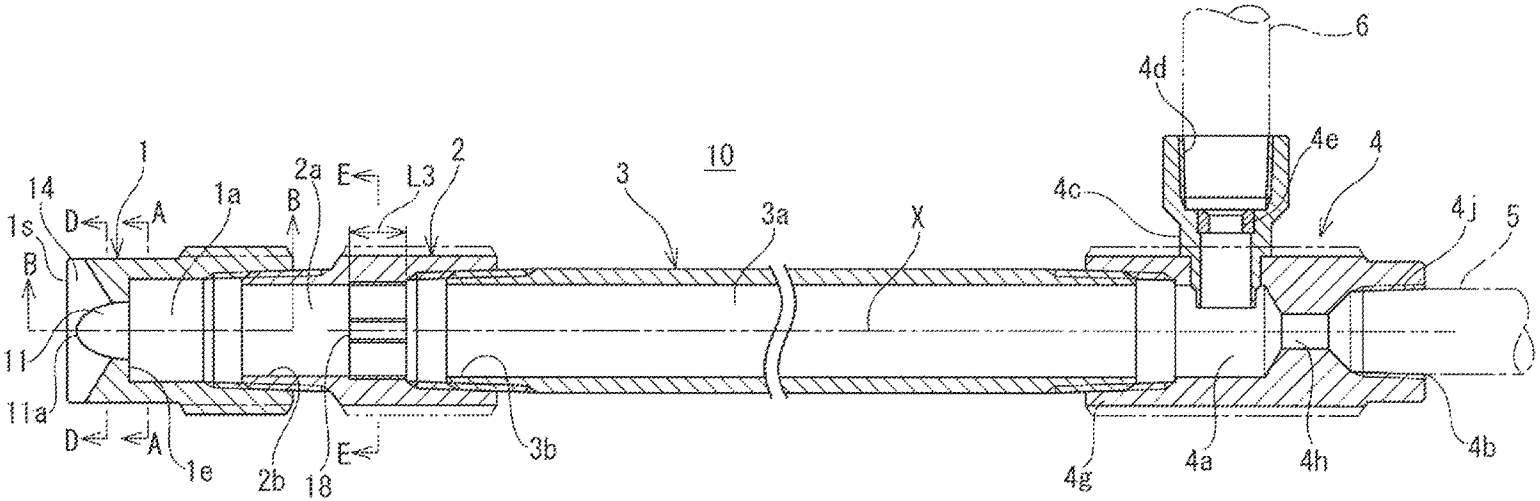
Fig. 1 ( A )
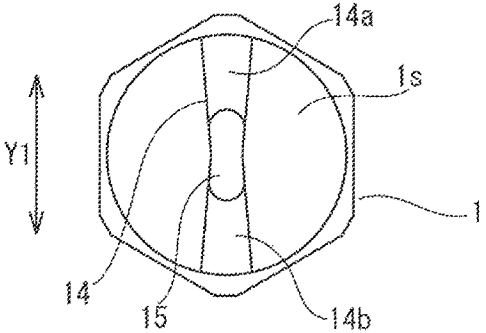
Fig. 1 ( C )
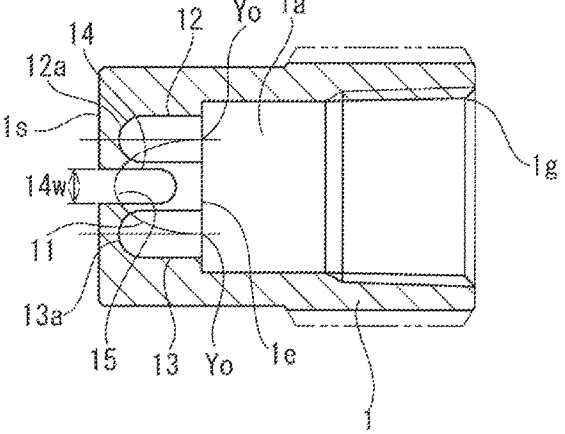
Fig. 1 ( B )

Fig. 2( A )
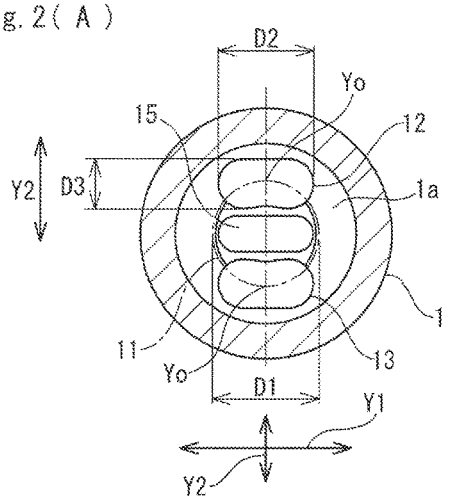
Fig. 2( B )
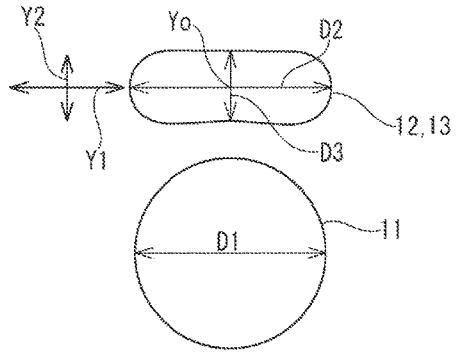
Fig. 2( C )
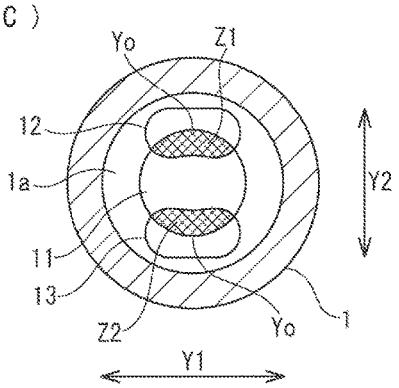
Fig. 2( D )
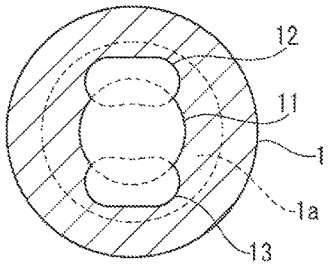
Fig. 3
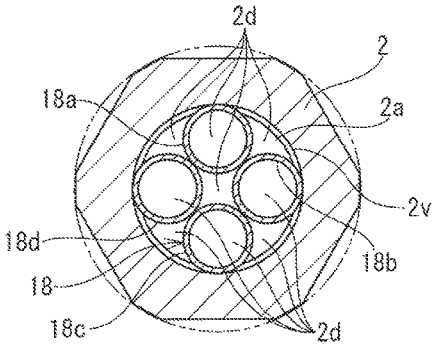

Fig. 4( A )
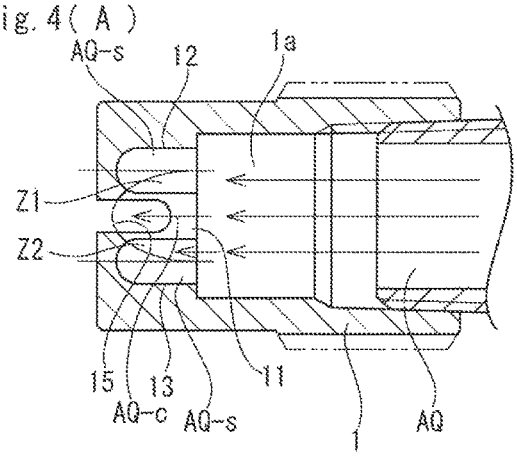
Fig. 4( B )
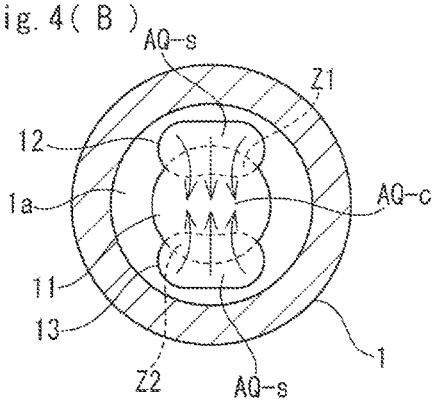
Fig. 4( C )
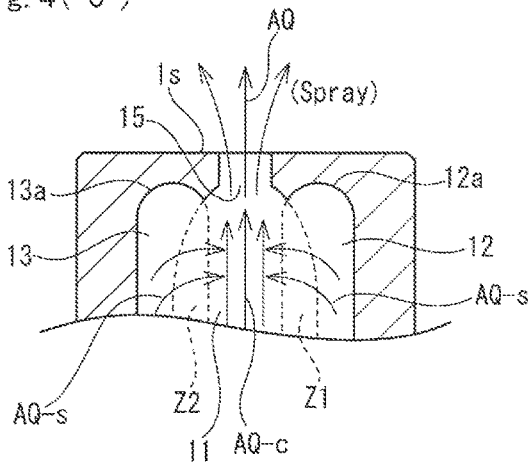

Fig. 5

| Measuring condition | Single item | |
|---|---|---|
| | Flow rate distribution | Hitting power distribution |
| Pa=0.018<br>Pw=0.010<br>Qa=200<br>Qw=1.0<br>H=200 | 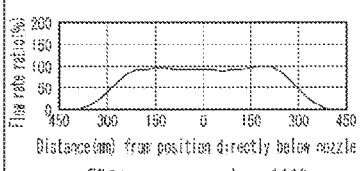 <br>50% spray angle=111° | 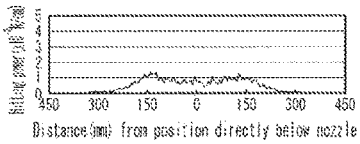 <br>MAX value=1.1(x10$^{-2}$N/cm)<br>Directly below nozzle=0.8(x10$^{-2}$N/cm) |
| Pa=0.025<br>Pw=0.016<br>Qa=200<br>Qw=2.0<br>H=200 | 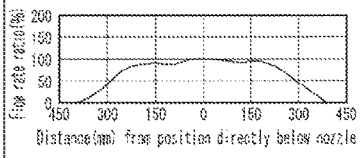 <br>50% spray angle=111° | 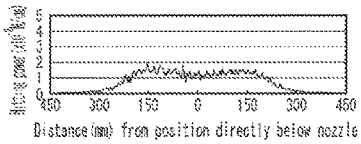 <br>MAX value=1.4(x10$^{-2}$N/cm)<br>Directly below nozzle=1.1(x10$^{-2}$N/cm) |
| Pa=0.096<br>Pw=0.110<br>Qa=200<br>Qw=10.0<br>H=200 | 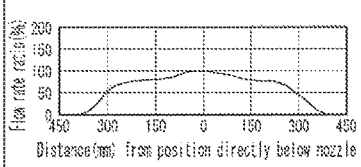 <br>50% spray angle=112° | 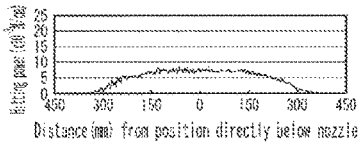 <br>MAX value=7.5(x10$^{-2}$N/cm)<br>Directly below nozzle=7.5(x10$^{-2}$N/cm) |
| Pa=0.193<br>Pw=0.272<br>Qa=200<br>Qw=20.0<br>H=200 | 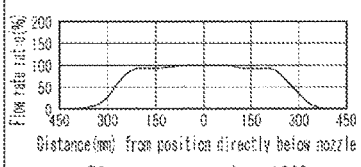 <br>50% spray angle=109° | 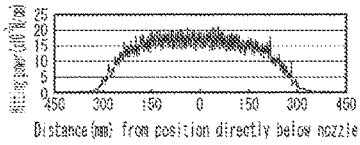 <br>MAX value=17.4(x10$^{-2}$N/cm)<br>Directly below nozzle=17.4(x10$^{-2}$N/cm) |
| Pa=0.315<br>Pw=0.485<br>Qa=200<br>Qw=30.0<br>H=200 | 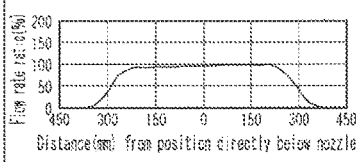 <br>50% spray angle=111° | 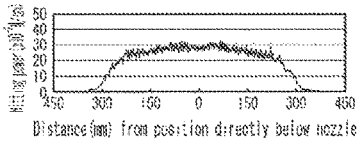 <br>MAX value=29.2(x10$^{-2}$N/cm)<br>Directly below nozzle=28.6(x10$^{-2}$N/cm) |
| Pa=0.439<br>Pw=0.720<br>Qa=200<br>Qw=40.0<br>H=200 | 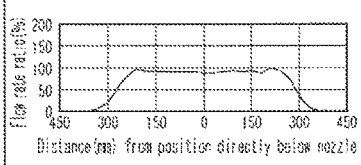 <br>50% spray angle=109° | 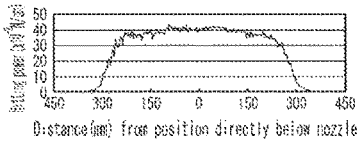 <br>MAX value=41.4(x10$^{-2}$N/cm)<br>Directly below nozzle=40.4(x10$^{-2}$N/cm) |

Fig. 6( A )
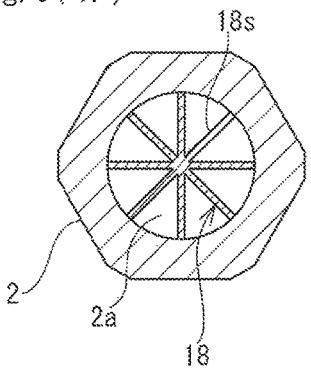
Fig. 6( B )
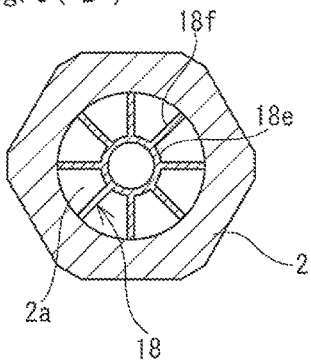
Fig. 6( C )
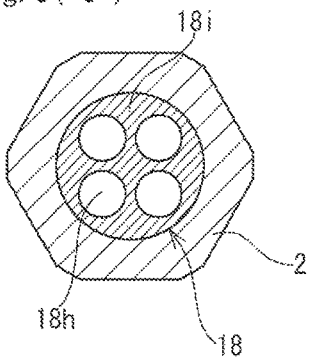
Fig. 7( A )
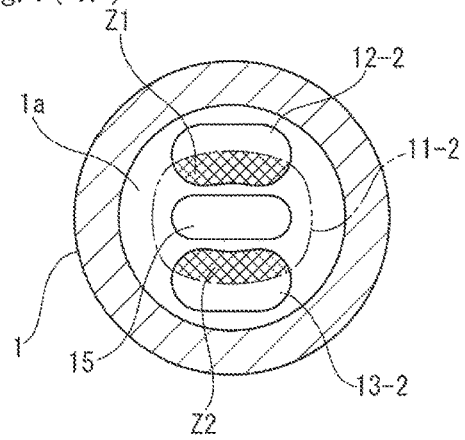
Fig. 7( B )
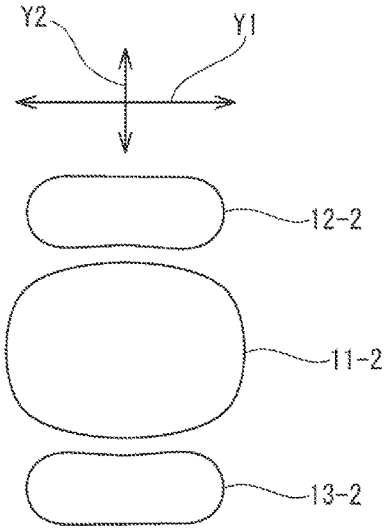

Fig. 8( A )
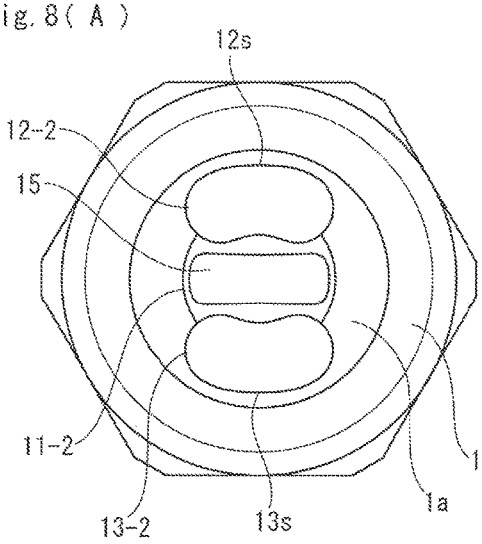
Fig. 8( B )
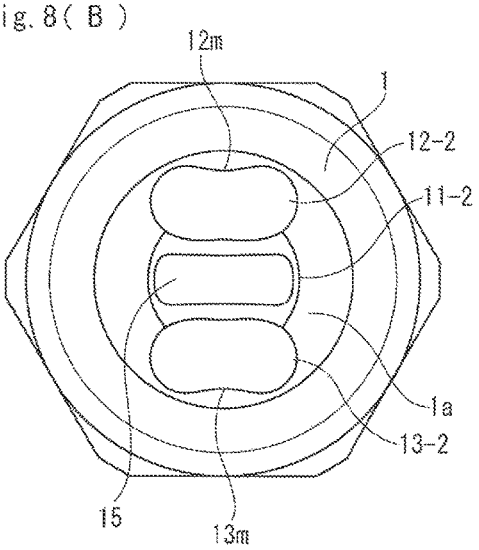

Fig. 9 ( A )
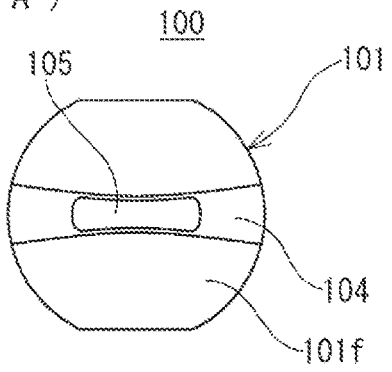
Fig. 9 ( B )
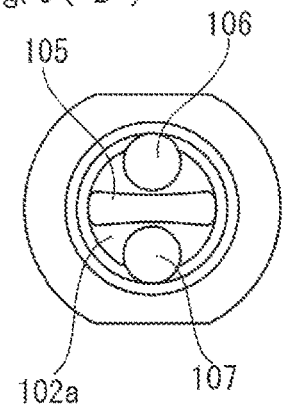
Fig. 9 ( C )
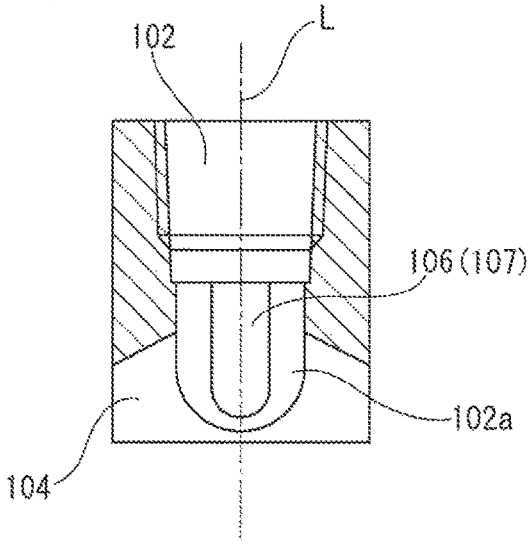

SPRAY NOZZLE

TECHNICAL FIELD

The present invention relates to a spray nozzle and more particularly to a nozzle preferably used to spray cooling water to slab continuously taken out to a secondary cooling zone of a continuous casting apparatus. In more detail, the present invention relates to a spray nozzle capable of preventing slab from being ununiformly cooled because the spray nozzle has a low degree of fluctuation in a spray angle even though a spray amount of cooling water is changed and is thus capable of providing a uniform flow rate distribution and a uniform hitting power distribution.

BACKGROUND ART

As a spray nozzle of this kind, the present applicant proposed a nozzle 100 shown in FIGS. 9(A) through 9(C), as disclosed in U.S. Pat. No. 2,719,073. Along the central axis L of a nozzle body 101, the nozzle 100 is provided with a main hole 102 serving as the gas-liquid mixing flow path for mixing water and compressed air with each other. The arc-shaped injection side front end of the lower hole portion 102*a* of the main hole 102 is formed proximately to the injection side end surface 101*f* of the nozzle body 101. A cut 104 diametrically formed on the injection side end surface 101*f* is communicated with the injection side front end portion of the lower hole portion 102*a* to form an oblong injection port 105. Sectionally circular auxiliary holes 106, 107 are formed at both sides of the lower hole portion 102*a* in the width direction thereof.

In the nozzle 100, owing to the construction in which the auxiliary holes 106, 107 are formed at both sides of the main hole 102, the gas-liquid mixture fluid which flows to both sides of the main hole 102 from the auxiliary holes 106, 107 is allowed to collide with the gas-liquid mixture fluid which flows along the central axis L of the main hole 102 so that the gas-liquid mixing is accelerated and the spray is homogenized. Thereby when the flow rate of water is low, it is possible to widen the spray angle. When the flow rate of the water is high, it is possible to restrain the spray angle from widening. Further even when the supply amount of the water is changed, it is possible to keep the spray angle approximately uniform.

Consequently, even though the supply amount of the water is changed with respect to a constant supply amount of compressed air, it is possible to keep the spray angle range, the flow rate distribution, the hitting power distribution, and the particle diameter uniformly. Thereby it is possible to uniformly cool slab by controlling the spray operation of the nozzle. This is attributed to an increased turndown ratio of 1:20. For example, the supply amount of water can be controlled in the range of 2 to 40 liters/minute with respect to a constant supply amount of compressed air constantly supplied at 0.4 NL/minute. By increasing the turndown ratio, it is possible to cool slab disposed in the range from the upstream region of the secondary cooling zone where it is necessary to supply a large amount of cooling water to the downstream region thereof where a small amount of the cooling water is sufficient for cooling the slab by using the same nozzle (nozzles), even though the thicknesses of the slab vary.

PRIOR ART DOCUMENT

Patent Document

Patent document 1: Japanese Patent Publication Number 2719073

SUMMARY OF THE INVENTION

Problems to be Solved by the Invention

The nozzle of the patent document 1 has the turndown ratio of 1:20 increased twice as high as the conventional turndown ratio of 1:10. But the nozzle is demanded to have a turndown ratio having a wide range so as to deal with varied thicknesses of slab. The spray angle at the time of the supply of a small amount of water is not stable as compared with the spray angle at the time of the supply of a large amount of water. Therefore the nozzle is demanded to have the turndown ratio in a wide range and stabilize the spray angle at the time of the supply of a small amount of water.

Therefore it is an object of the present invention to provide a nozzle having a turndown ratio in a range larger than 1:20 and capable of stably keeping a spray angle at the time of the supply of a small amount of water equivalently to a spray angle at the time of the supply of a large amount of water.

Means for Solving the Problems

To solve the above-described problems, the present invention provides a spray nozzle in which a conical main hole which becomes narrower toward an injection side front end of a nozzle body is formed at a center of an injection-side front-end surface of a main flow path formed along a central axis of a nozzle body with the main hole communicating with the main flow path; and a pair of auxiliary holes is formed at both sides of the main hole in a width direction thereof with the auxiliary holes communicating with the main flow path and the main hole;

the auxiliary holes are formed in an oblong shape; long-side portions of the auxiliary holes opposed to each other with the auxiliary holes sandwiching the main hole therebetween and both side portions of the main hole are communicated with each other; and a ratio of a major axis dimension (D2) of the auxiliary holes to a rear-end diameter (D1) of the main hole is set to: D1:D2=1:0.7 to 1:1.2;

a cut is formed on an injection side end surface of the nozzle body in a diametrical direction parallel with a major axis direction of the auxiliary holes to form an injection port by cutting out an arc-shaped front end portion of the main hole with the cut.

It is preferable that a gas-liquid mixture fluid of a liquid consisting of water and a gas consisting of compressed air is introduced into the main flow path of the nozzle body.

The main hole is formed in a sectionally circular shape, and the auxiliary holes are formed in a sectionally oblong shape.

A ratio of a minor axis dimension D3 of the auxiliary holes to the rear-end diameter D1 of the main hole is set to: D1:D3=1:0.3 to 1:0.7.

A ratio of the major axis dimension D2 of the auxiliary holes to the minor axis dimension D3 thereof is set to: D3:D2=1:1.5 to 1:2.5.

It is preferable that the injection port is formed in an oblong configuration and that a guide concave portion whose width is set to gradually increase toward an outer peripheral edge of the spray-side end surface of the nozzle body is formed at both ends of the injection port in its longitudinal direction.

As described above, by so constructing the spray nozzle that the auxiliary holes disposed at both sides of the main hole are formed in the sectionally oblong shape and that the opposed long-side portions of both auxiliary holes are continuous with both sides of the main hole, it is possible to increase the area of overlapped portions where the auxiliary holes and the main hole overlap each other. In the overlapped portions, the gas-liquid mixture fluid which has flowed into the main hole from the auxiliary holes and the gas-liquid mixture fluid which advances straight inside the main hole toward the injection port collide with each other and are stirred together.

As compared with a case where the auxiliary holes are formed in a sectionally circular shape as conventionally done, the sectionally oblong auxiliary holes increase the area of the overlapped portions where the auxiliary holes and the main hole overlap each other, i.e., increase the area of the portion where the gas-liquid mixture fluids are stirred together. The stirring accelerates the homogenization of the gas-liquid mixture fluid. Thereby even though the flow rate of the liquid greatly fluctuates, owing to the stirring-caused homogenization of the gas-liquid mixture fluid, it is possible to decreasingly fluctuate the spray angle of the gas-liquid mixture fluid injected from the injection port and obtain a uniform flow rate distribution and a uniform hitting power distribution.

In the above-described construction, each of the auxiliary holes sectionally oblong is divided into two parts in the major axis direction thereof. About the half of each of the auxiliary holes disposed at the side of the main hole is continuous with the auxiliary holes overlapping the main hole disposed at the center between the auxiliary holes. Thereby it is possible to increase the stirring area in which the fluid at the side of the main hole and the fluid at the side of the auxiliary holes are stirred together. Owing to an increase of the stirring area, as described above, it is possible to accelerate the homogenization of the gas-liquid mixture fluid and stably spray the gas-liquid mixture fluid from the injection port. Consequently when the flow rate of the liquid is greatly fluctuated, it is possible to restrain the spray angle, the flow rate distribution, and the hitting power distribution from fluctuating. Thus the nozzle of the present invention does not ununiformly cool slab and the like.

Even in a case where the nozzle of the present invention is used as a one-fluid nozzle in which only a liquid flows into the main hole of the nozzle body and the auxiliary holes thereof, the gas-liquid mixture fluid can be stirred to a high extent owing to an increase in the area of the overlapped portion where the main hole and the auxiliary holes overlap each other as in the case of the two-fluid nozzle. Thus it is possible to homogenize the sizes of droplets and decrease the degree of fluctuation of the spray angle. Thereby the nozzle is capable of providing a uniform flow rate distribution and a uniform hitting power distribution.

The long hole-shaped auxiliary holes may be formed in a sectionally oblong shape or in a sectionally elliptic shape.

The main hole may be formed in a sectionally oblong shape. The long-side portions of the auxiliary holes sectionally oblong may be continuous with both sides of the long-side portions of the main hole. In this case, the ratio of the major axis dimension of the main hole at its rear end to the minor axis dimension thereof at its rear end is set to favorably 1:1 to 1:2 and more favorably 1:1 to 1:1.4. The nozzle having the above-described construction is preferably used in a case where it is necessary to form the nozzle body in the sectionally oblong shape.

In the nozzle of the present invention having the above-described construction, when the supply amount of the liquid with respect to a constant supply amount of compressed air fluctuates within a range of a turndown ratio of 1:40, a fluctuation angle of the spray angle is set to not more than five degrees.

Although the turndown ratio of the conventional nozzle shown in FIG. 9 is 1:20, the turndown ratio of the nozzle of the present invention is set to 1:40 twice as large as that of the conventional nozzle.

Because the nozzle of the present invention has a high turndown ratio as described above, the nozzle can be preferably used in a case where it is necessary to greatly change a cooling temperature in response to cases where the thicknesses of slab vary greatly, the secondary cooling zone is long, and the like.

It is preferable that the nozzle body is disposed integrally or connectedly at a front end of the gas-liquid mixture fluid supply pipe having the rectifying plate mounted thereon; and a liquid supply pipe and a gas supply pipe are connected to a proximal side of the gas-liquid mixture fluid supply pipe with the liquid supply pipe being orthogonal to the gas supply pipe and that the rectifying plate provides a plurality of separate flow paths parallel with the central axis of the nozzle body.

In more detail, it is preferable to connect the nozzle body to the gas-liquid mixture fluid supply pipe consisting of the straight pipe through the rectifying adaptor, connect the gas-liquid mixture fluid supply pipe to the mixing adaptor, and connect the liquid supply pipe and the gas supply pipe to the mixing adaptor with the liquid supply pipe and the gas supply pipe being orthogonal to each other.

It is also preferable to align the central axis of the rectifying adaptor with that of the nozzle body and mount the rectifying plate having the separate flow paths parallel with the central axis of the rectifying plate on a flow path formed along the central axis thereof.

It is preferable to provide the nozzle with a construction in which compressed air is supplied to the mixing adaptor from the gas supply pipe and water is supplied orthogonally to the mixing adaptor from the liquid supply pipe to allow the compressed air and the water to collide and mix with each other, the gas-liquid mixture fluid is flowed to the rectifying adaptor from the mixing adaptor through the gas-liquid mixture fluid supply pipe consisting of the straight pipe, the gas-liquid mixture fluid is rectified inside the rectifying adaptor to flow the gas-liquid mixture fluid into the main hole inside the nozzle body and into the auxiliary holes disposed at both sides of the main hole.

As described above, after the rectifying plate is disposed at a position of the flow path upstream from the nozzle body to rectify the gas-liquid mixture fluid which has flowed into the nozzle body, the gas-liquid mixture fluid is stirred at the overlapped portion where the main hole and the auxiliary holes overlap each other. It is possible to accelerate the homogenization of droplets by sequentially mixing the water and the compressed air with each other inside the mixing adaptor, rectifying the gas-liquid mixture fluid by the rectifying plate, and stirring the two gas-liquid mixture fluids owing to collision and mixing therebetween inside the nozzle body.

The rectifying plate may be projected from an inner surface of the flow path of the rectifying adaptor in integration therewith or may be formed separately therefrom and fixedly inserted into the flow path.

It is preferable to locate the rectifying plate at a position spaced 3 cm to 8 cm from the injection port of the nozzle body, set the length of the rectifying plate to 5 mm to 30 mm, and divide one inflow-side flow path of the rectifying plate into 5 to 10 separate flow paths.

The spray nozzle of the present invention can be widely used to cool slab taken out to the secondary cooling zone of the continuous casting apparatus; cool steel plates such as thick and thin plates, and plated plates; cool steel pipes such as seamless pipes; perform controlled cooling after rolling operation and heat treatment finish; perform surface treatment of steel plates; cool plates such as aluminum plates, glass plates; and cool exhaust gas.

It is preferable to dispose the spray nozzles of the present invention by arranging them in parallel at certain intervals in the width direction of materials such as slab to be cooled and by overlapping sprays injected from the nozzles each other to allow the flow rate at both sides of the spray range to be equal to that at the central portion of the spray range.

Effect of the Invention

In the spray nozzle of the present invention, by so constructing the spray nozzle that the auxiliary holes disposed at both sides of the main hole of the nozzle body are formed in the sectionally oblong shape and that the opposed long-side portions of both auxiliary holes are continuous with both sides of the main hole, it is possible to increase the area of the overlapped portions where the auxiliary holes and the main hole overlap each other. In the overlapped portions, the gas-liquid mixture fluid which has flowed into the min hole from the auxiliary holes and the gas-liquid mixture fluid which advances straight inside the main hole toward the injection port are allowed to collide with each other and to be stirred together.

As compared with the case where the auxiliary holes are formed in the sectionally circular shape as conventionally done, the sectionally oblong auxiliary holes increase the area of the overlapped portions where the auxiliary holes and the main hole overlap each other, i.e., increase a stirring amount. The stirring accelerates the homogenization of the gas-liquid mixture fluid. Thereby even though the flow rate of the liquid greatly fluctuates, owing to the stirring-caused homogenization of the gas-liquid mixture fluid, it is possible to decreasingly fluctuate the spray angle of the gas-liquid mixture fluid injected from the injection port and obtain a uniform flow rate distribution and a uniform hitting power distribution.

BRIEF DESCRIPTION OF THE DRAWINGS

FIGS. 1(A)-1(C) show a spray nozzle of a first embodiment of the present invention, in which FIG. 1(A) is a sectional view taken along an axial line; FIG. 1(B) is a sectional view taken along a line B-B of FIG. 1(A); and FIG. 1(C) is a left-side view.

FIG. 2(A) is a sectional view taken along a line A-A of FIG. 1(A); FIG. 2(B) is a schematic view showing a main hole and an auxiliary hole in comparison; FIG. 2(C) shows an overlapped portion where the main hole and the auxiliary hole overlap each other; and FIG. 2(D) is a sectional view taken along a line D-D of FIG. 1(A).

FIG. 3 shows a rectifying plate and is a sectional view taken along a line E-E of FIG. 1(A).

FIGS. 4(A) through 4(C) are sectional views for explaining the operation of the spray nozzle.

FIG. 5 shows experimental results.

FIG. 6(A) is a sectional view showing a first modification of the rectifying plate; FIG. 6(B) is a sectional view showing a second modification of the rectifying plate; and FIG. 6(C) is a sectional view showing a third modification of the rectifying plate.

FIGS. 7(A) and 7(B) show a second embodiment, in which FIG. 7(A) is a sectional view of a nozzle body; and FIG. 7(B) is a schematic view showing a main hole and an auxiliary hole.

FIGS. 8(A) and 8(B) show modifications of the auxiliary hole of the second embodiment.

FIGS. 9(A) through 9(C) show a conventional art.

MODE FOR CARRYING OUT THE INVENTION

The embodiments of the present invention are described below with reference to the drawings.

FIGS. 1 through 4 show a first embodiment.

A spray nozzle 10 of the first embodiment consisting of a two-fluid nozzle is disposed in a secondary cooling zone of a continuous casting apparatus to spray cooling mist to a slab from above the slab.

As shown in FIG. 1(A), the spray nozzle 10 is formed by sequentially connecting a rectifying adaptor 2 to a nozzle body 1, a gas-liquid mixture fluid supply pipe 3 (hereinafter referred to as fluid supply pipe 3) consisting of a straight pipe to the rectifying adaptor 2, and a mixing adaptor 4 to the gas-liquid mixture fluid supply pipe 3 with central axes X thereof being aligned with one another. A main flow path 1*a* of the nozzle body 1, a main flow path 2*a* of the rectifying adaptor 2, a main flow path 3*a* of the fluid supply pipe 3, and a main flow path 4*a* of the mixing adaptor 4 communicate with one another with the central axes X thereof being aligned with one another. A compressed air supply pipe 5 is connected to a rear-end opening 4*b* of the main flow path 4*a* of the mixing adaptor 4. A liquid supply pipe 6 is connected to the main flow path 4*a* at a right angle thereto.

As shown in FIG. 1(B), a main hole 11 is formed at a center of an injection-side front-end surface 1*e* of the main flow path 1*a* formed along the central axis X with the main hole 11 communicating with the main flow path 1*a*. A pair of auxiliary holes 12, 13 is formed at both sides of the main hole 11 with the auxiliary holes 12, 13 communicating with the main flow path 1*a* and the main hole 11.

More specifically, the nozzle body 1 is approximately cylindrical. A hollow part of the nozzle body is formed as the main flow path 1*a* sectionally circular. The main hole 11 is formed at the center of the front end surface 1*e* of the main flow path 1*a* sectionally circular. The auxiliary holes 12, 13 sectionally oblong are formed at both sides of the main hole 11. The auxiliary holes 12, 13 are continuous with the main hole 11.

The main hole 11 is formed conically by gradually decreasing a sectional area of a flow path of the main hole 11 toward an axial front end of the injection side thereof. The front end of the main hole 11 is arc-shaped to form a arc-shaped front end portion 11*a* positioned proximately to an injection side end surface 1*s* of the nozzle body 1.

A pair of the auxiliary holes 12, 13 is symmetrical with respect to the central axis X. The arc-shaped front end portions 12*a*, 13*a* are formed at the spray side front ends of the auxiliary holes 12, 13 respectively. The distance between positions of the arc-shaped front end portions 12*a*, 13*a* and the injection side end surface 1*s* is a little longer than or equal to the distance between the position of the arc-shaped front end portion 11*a* of the main hole 11 and the injection side end surface 1*s*. That is, the arc-shaped front end portions 12*a*, 13*a* of the auxiliary holes 12, 13 are not projected to the spray side beyond the arc-shaped front end portion 11*a* of the main hole 11.

As shown in FIG. 1(C), a cut 14 sectionally concave is diametrically formed into the injection side end surface 1*s* of the nozzle body 1. The cut 14 is formed parallel with a long-side direction Y1 of the auxiliary holes 12, 13 and is so tapered that it becomes gradually deeper toward its center. As shown in FIG. 1(B), a width 14*w* of the cut 14 is so set that the cut 14 does not interfere with the auxiliary holes 12, 13 disposed at both sides of the main hole 11. The cut 14 interferes with the arc-shaped front end portion 11*a* of the main hole 11, thus cutting out only the arc-shaped front end portion 11*a* to form an oblong injection port 15. The width of the cut 14 is increased toward both ends at an outer peripheral side thereof to form guide concave portions 14*a*, 14*b* at both ends of the injection port 15 in its longitudinal direction. The widths of the guide concave portions 14*a*, 14*b* gradually increase toward the outer peripheral edge of the spray-side end surface of the nozzle body.

The auxiliary holes 12, 13 are formed in a sectionally oblong shape. Long-side portions of the left and right auxiliary holes 12, 13 disposed at the main hole side overlap both side portions of the main hole 11. The auxiliary holes 12, 13 are continuous with the main hole 11 at overlapped portions Z1, Z2 shown with crossed diagonal lines in FIG. 2(C). As described above, the main hole 11 is conical in such a way as to become gradually narrower toward the injection port 15 and is sectionally circular. At the rear end of the main hole 11 at which the main hole 11 has a maximum area, namely, at a boundary position between the rear end of the main hole 11 and the front end surface 1*e* of the main flow path 1*a*, the outer periphery of the main hole 11 is coincident with a central point Yo of each of the auxiliary holes 12, 13. Because the main hole 11 is conical in such a way as to become gradually narrower toward its front end, the sectional areas of the overlapped portions Z1, Z2 become gradually smaller toward the spray-side end surface of the nozzle body.

The ratio of a major axis dimension (D2) of the auxiliary holes 12, 13 to a rear-end diameter (D1) of the main hole 11 is set to: D1:D2=1:0.7 to 1:1.2. Because the main hole 11 is sectionally circular, the rear-end diameter (D1) thereof is the diameter of the rear end of the main hole 11.

The ratio of a minor axis dimension D3 of the auxiliary holes 12, 13 to the rear-end diameter D1 of the main hole 11 is set to: D1:D3=1:0.3 to 1:0.7.

The ratio of the major axis dimension D2 of the auxiliary holes 12, 13 to the minor axis dimension D3 thereof is set to: D3:D2=1:1.5 to 1:2.5.

The reason the ratio of the minor axis dimension D3 of the auxiliary holes 12, 13 to the rear-end diameter D1 of the main hole 11 and the ratio of the minor axis dimension D3 of the auxiliary holes 12, 13 to the major axis dimension D2 thereof are set to the above-described ranges is because an inflow rate of a gas-liquid mixture fluid into the auxiliary holes 12, 13 is secured at a required amount and a stirring amount of the gas-liquid mixture fluid which flows into the main hole 11 from the auxiliary holes 12, 13 is secured at a required amount. In a case where the minor axis dimension D3 of the auxiliary holes 12, 13 is set smaller than the above-described range, the area of the overlapped portion where the main hole 11 and the auxiliary holes 12, 13 overlap each other becomes smaller and as a result, the stirring effect becomes smaller. On the other hand, in a case where the minor axis dimension D3 of the auxiliary holes 12, 13 is set larger than the above-described range, there occurs a problem that the nozzle body becomes large.

A front insertion portion 2*b* of the rectifying adaptor 2 is inserted into a rear-end opening 1*g* of the main flow path 1*a* of the nozzle body 1 and threadedly engaged thereby. Thereby the rectifying adaptor 2 is coupled to the main flow path 1*a*. The rectifying adaptor 2 is cylindrical. A hollow portion of the rectifying adaptor 2 serves as the main flow path 2*a*. A rectifying plate 18 is mounted on the main flow path 2*a* at an intermediate position thereof.

As shown in FIG. 3, the rectifying plate 18 is composed of four small cylinders 18*a* through 18*d* continuously arranged at intervals of 90 degrees. The diameter of a virtual circle surrounding the four small cylinders 18*a* through 18*d* is set equally to that of the main flow path 2*a*. A fitting concave portion 2*v* is annularly formed on a peripheral surface of the main flow path 2*a* to press-fit a peripheral portion of the rectifying plate 18 to the fitting concave portion 2*v*. By disposing the rectifying plate 18 on the main flow path 2*a*, nine separate flow paths 2*d* parallel with the central axis X are formed.

A length L3 of the rectifying plate 18 is set to 5 mm to 30 mm. A front end position of the rectifying plate 18 is spaced 3 cm to 6 cm from the injection port 15 of the nozzle body 1.

A front insertion portion 3*b* of the fluid supply pipe 3 consisting of a straight pipe is inserted into a rear-end opening of the rectifying adaptor 2 and threadedly engaged thereby. Thereby the fluid supply pipe 3 is coupled to the rectifying adaptor 2.

A front insertion portion 4*g* of the mixing adaptor 4 is externally fitted on a rear portion of the fluid supply pipe 3 and threadedly engaged thereby. Thereby the mixing adaptor 4 is coupled to the fluid supply pipe 3. The main flow path 4*a* of the mixing adaptor 4 communicates with the main flow path 3*a* whose diameter is approximately equal to that of the main flow path 4*a*. A liquid insertion pipe 4*c* is orthogonally inserted into an opening formed at one side portion of the main flow path 4*a* and fixed to the opening. The liquid supply pipe 6 is coupled to a front end opening 4*d* of the liquid insertion pipe 4*c*. An orifice 4*e* is formed on the liquid insertion pipe 4*c* by reducing the sectional area of the flow path so as to flow pressurized water into the main flow path 4*a* from a side thereof.

A small-diameter flow path 4*h* is formed continuously with the rear end of the main flow path 4*a* of the mixing adaptor 4. A large-diameter insertion hole 4*j* is formed continuously with the small-diameter flow path 4*h*. The compressed air supply pipe 5 is inserted into the rear-end opening 4*b* of the main flow path 4*a* and coupled thereto.

In the mixing adaptor 4, compressed air is flowed from the compressed air supply pipe 5 into the main flow path 4*a* through the small-diameter flow path 4*h*. The compressed air and the pressurized water which has flowed into the main flow path 4*a* sideways collide and mix with each other.

The compressed air supply pipe 5 supplies air set to a required pressure by a compressor (not shown) to the spray nozzle 10 at a constant flow rate.

Water set to a required pressure by a pump (not shown) is supplied to the liquid supply pipe 6 by adjusting its amount in a wide range of a turndown ratio of 1:40.

The operation of the spray nozzle 10 of the present invention is described below with reference to FIGS. 4(A) through 4(C). Pressure air set to the required pressure is supplied into the mixing adaptor 4 from the compressed air supply pipe 5 serving as the gas supply pipe. Water is supplied from the liquid supply pipe 6 into the mixing adaptor 4 in a direction orthogonal to the mixing adaptor 4 to allow the pressure air and the water to collide and mix with each other. A gas-liquid mixture fluid AQ which is the mixture of the water and the pressure air is flowed from the mixing adaptor 4 to the rectifying adaptor 2 through the fluid supply pipe 3 and rectified through the rectifying plate 18 inside the rectifying adaptor 2. The rectified gas-liquid mixture fluid AQ flows into the main flow path 1*a* inside the nozzle body 1.

A gas-liquid mixture fluid AQ-c disposed at a central portion of the main flow path 1*a* flows into the main hole 11, whereas a gas-liquid mixture fluid AQ-s disposed at both sides of the gas-liquid mixture fluid AQ-c flows into the auxiliary holes 12, 13 disposed at both sides of the main hole 11.

About half of each of the auxiliary holes 12, 13 in the long sides thereof overlaps the main hole 11 at both sides thereof. In the overlapped portions Z1, Z2, the gas-liquid mixture fluid AQ-s which has flowed into the auxiliary holes 12, 13 flows into the main hole 11 from the side thereof and collide and mix with the gas-liquid mixture fluid AQ-c which has flowed into the main hole 11. Thereby the gas-liquid mixture fluid AQ is stirred. The stirring accelerates the homogenization of the gas-liquid mixture fluid AQ.

As shown in FIG. 4(C), the homogenized gas-liquid mixture fluid AQ is injected outward from the oblong injection port 15 disposed at the front end of the main hole 11. The injection port 15 is so constructed that it is sandwiched between both sidewalls of the cut 14 and that the guide concave portions 14*a*, 14*b* are extended continuously with both ends of the injection port 15 in its longitudinal direction. Thus the gas-liquid mixture fluid AQ injected from the injection port 15 spreads to both sides of the injection port 15 along the guide concave portions 14*a*, 14*b*. Thereby the flow rate of the gas-liquid mixture fluid AQ which flows directly below the spray nozzle is decreased, whereas the flow rate of the gas-liquid mixture fluid AQ which flows to both sides of the injection port 15 is increased. Thus the gas-liquid mixture fluid AQ forms a trapezoidal spray pattern having a range in which a uniform flow rate is long. In addition, droplets in the injected gas-liquid mixture fluid AQ are atomized and mixed with the pressure air to form a homogenized spray. Therefore supposing that the amount of the pressure air is constant, a spray angle which forms a spray pattern hardly fluctuates and it is possible to provide an almost uniform liquid volume distribution and hitting power distribution within a spray range, even though a liquid amount is changed.

Tables of FIG. 5 show results of experiments conducted by using the spray nozzle of the above-described embodiment.

In the tables of FIG. 5,

Pa (air pressure): MPa

Pw (liquid pressure): MPa

Qa (amount of air): NL/minute

Qw (amount of liquid): L/minute

H (distance from position directly below nozzle): mm

50% injection angle shown in the tables means an angle calculated by a trigonometric function from a spray height and a spread dimension at a ratio of 50% with respect to a highest value in a flow rate distribution set to 100.

As shown in the tables of FIG. 5, the amount of air (Qa) was set to a constant amount of 200 NL/minute. The amount of liquid (Qw) was changed as follows: 1.0 L/minute→2.0 L/minute→10.0 L/minute→20.0 L/minute→30.0 L/minute→40.0 L/minute. As a result, the 50% injection angle fluctuated only three degrees as shown below: 111 degrees→111 degrees→112 degrees→109 degrees→111 degrees→109 degrees. The flow rate distributions and the hitting power distributions were almost uniform.

As described above, it is possible to increase the turndown ratio of the spray nozzle 10 of the present invention set as the liquid flow rate control range to 1:40 which is twice of the conventional turndown ratio. Therefore the spray nozzle is adaptable for different thicknesses of slab, different installed regions of the spray nozzle, and different spray time zones by changing a liquid amount and is responsive to demands of high-mix low-volume production.

The present invention is not limited to the above-described embodiment. The rectifying plate may have constructions of modifications shown in FIGS. 6(A), 6(B), and 6(C).

The rectifying plate 18 of a first modification shown in FIG. 6(A) has a configuration, namely, a so-called feather type in which eight partitioning plates 18*s* are radially formed from the center thereof.

The rectifying plate 18 of a second modification shown in FIG. 6(B) has a configuration, namely, a so-called vane type in which eight partitioning plates 18*f* are projected from a peripheral surface of a central cylindrical portion 18*e* at equiangular intervals.

The rectifying plate 18 of a third modification shown in FIG. 6(C) has a configuration, namely, a so-called perforated type in which four holes 18*h* are formed through a sectionally circular body 18*i* as separate flow paths at intervals of 90 degrees. The perforated type has an advantage of allowing the separate flow paths to be sectionally circular and preventing corners from being formed.

FIGS. 7(A) and 7(B) show a spray nozzle of a second embodiment.

In the spray nozzle of the second embodiment, a main hole 11-2 communicating with a front end of the main flow path 1*a* of the nozzle body 1 is formed in a sectionally oblong shape. A long side direction Y1 of the main hole 11-2 is disposed parallel with the long side direction Y1 of auxiliary holes 12-2, 13-2, having a sectionally oblong shape, which are disposed at both sides of the main hole 11-2. A short-side direction Y2 of the main hole 11-2 is also parallel with that of the auxiliary holes 12-2, 13-2.

The ratio of a major axis dimension of the main hole 11-2 at its rear end in its long-side direction Y1 to a minor axis dimension of the main hole 11-2 at its rear end in its short-side direction Y2 is set to 1:1 to 1.2, preferably 1:1 to 1.4.

The opposed long-side portions of the auxiliary holes 12-2, 13-2 overlap both sides of the main hole 11-2 at its long sides to form the overlapped portions Z1, Z2 shown with crossed diagonal lines in FIG. 7(A).

Because the other constructions and the operation and effect of the second embodiment are similar to those of the first embodiment, description thereof is omitted herein.

FIGS. 8(A) and 8(B) show a modification of the auxiliary holes 12-2, 13-2 of the second embodiment whose configuration is changed. The main hole 11-2 is formed in a sectionally circular shape as in the case of the auxiliary hole of the first embodiment.

As shown in FIG. 8(A), long sides 12*s*, 13*s* of both auxiliary holes 12-2, 13-2 which are disposed uncontinuously with and opposite to the long sides thereof continuous with the main hole 11-2 are formed not straightly but bulged outward in the shape of a circular arc so that both auxiliary holes 12-2, 13-2 are formed in a sectionally elliptic shape. This configuration is capable of increasing the amount of a fluid which flows from the auxiliary holes 12-2, 13-2 into the main hole 11-2 from its side and the spray angle.

As shown in FIG. 8(B), the long sides 12*m*, 13*m* of both auxiliary holes 12-2, 13-2 disposed uncontinuously with and oppositely to the long sides thereof continuous with the main hole 11-2 are tilted inward toward the center in the longitudinal direction thereof to form the outer long sides 12*m*, 13*m* of the auxiliary holes 12-2, 13-2 in a gourd shape. This configuration is capable of decreasing the amount of a fluid which flows from the auxiliary holes 12-2, 13-2 into the main hole 11-2 from its side and the spray angle.

The spray nozzle of the first embodiment is formed as the two-fluid nozzle in which the mixing adaptor is connected to the liquid supply pipe and the gas supply pipe to spray the gas-liquid mixture fluid. But the spray nozzle of the present invention may be formed as a one-fluid nozzle in which only the liquid supply pipe is connected to the fluid supply pipe 3 to flow only the liquid to the nozzle body 1 of the first embodiment through the rectifying adaptor 2 so that the one-fluid nozzle sprays an atomized liquid.

The fluid supply pipe continuous with the nozzle body through the rectifying adaptor may be formed not as the straight pipe, but as a curved pipe.

EXPLANATION OF REFERENCE SYMBOLS AND NUMERALS

1: nozzle body
2: rectifying adaptor
3: gas-liquid mixture fluid supply pipe
4: mixing adaptor
1*a*, 2*a*, 3*a*, 4*a*: main flow path
5: compressed air supply pipe
6: liquid supply pipe
10: spray nozzle
11: main hole
12, 13: auxiliary hole
14: cut
14*a*, 14*b*: guide concave portion
15: injection port
18: rectifying plate
Z1, Z2: overlapped portion
X: central axis

The invention claimed is:

1. A spray nozzle in which a conical main hole which becomes narrower toward an injection side front end of a nozzle body is formed at a center of an injection-side front-end surface of a main flow path formed along a central axis of the nozzle body with said main hole communicating with said main flow path; and a pair of auxiliary holes is formed at both sides of said main hole in a width direction thereof with said auxiliary holes communicating with said main flow path and said main hole;

said auxiliary holes are formed in an oblong shape; long-side portions of said auxiliary holes opposed to each other with said auxiliary holes sandwiching said main hole therebetween and both side portions of said main hole are communicated with each other; and a ratio of a major axis dimension (D2) of said auxiliary holes to a rear-end diameter (D1) of said main hole is set to: D1:D2=1:0.7 to 1:1.2; and a cut is formed on an injection side end surface of said nozzle body in a diametrical direction parallel with a major axis direction of said auxiliary holes to form an injection port by cutting out an arc-shaped front end portion of said main hole with said cut;

wherein in a state where a flow rate of a liquid with respect to a constant amount of pressure air fluctuates within a range of a turndown ratio of 1:40, a fluctuation angle of a spray angle is set to not more than five degrees;

wherein a gas-liquid mixture fluid of a liquid consisting of water and a gas consisting of compressed air is introduced into said main flow path of said nozzle body;

said main hole is formed in a sectionally circular shape, and said auxiliary holes are formed in a sectionally oblong shape;

a ratio of a minor axis dimension D3 of said auxiliary holes to said rear-end diameter D1 of said main hole is set to: D1:D3=1:0.3 to 1:0.7; and a ratio of said major axis dimension D2 of said auxiliary holes to said minor axis dimension D3 thereof is set to: D3:D2=1:1.5 to 1:2.5.

2. The spray nozzle according to claim 1, wherein said nozzle body is disposed integrally or connectedly at a front end of a gas-liquid mixture fluid supply pipe having a rectifying plate mounted thereon; and a liquid supply pipe and a gas supply pipe are connected to a proximal side of said gas-liquid mixture fluid supply pipe with said liquid supply pipe being orthogonal to said gas supply pipe; and said rectifying plate provides a plurality of separate flow paths parallel with said central axis of said nozzle body.

* * * * *